United States Patent [19]

Kawada et al.

[11] Patent Number: 4,854,422

[45] Date of Patent: Aug. 8, 1989

[54] HAND-OPERATED LIFT TRUCK

[75] Inventors: Hiroyuki Kawada; Kiminori Niwa, both of Takahamashi, Japan

[73] Assignee: Sugiyasu Iron Works Inc., Japan

[21] Appl. No.: 926,798

[22] Filed: Nov. 4, 1986

[30] Foreign Application Priority Data

Dec. 27, 1985 [JP] Japan ..... 60-203161[U]
Apr. 11, 1986 [JP] Japan ..... 61-53516[U]

[51] Int. Cl.[4] ..... B66B 9/20

[52] U.S. Cl. ..... 187/9 R; 280/47.11; 180/19.2

[58] Field of Search ..... 187/9 R, 9 E, 18, 8.71, 187/17; 280/43.12, 47.11; 180/19.2; 254/122, 89 R, 26

[56] References Cited

U.S. PATENT DOCUMENTS 3,576,333 4/1971 Danielson et al. ..... 280/43.12
3,817,546 6/1974 Sugiura ..... 280/43.12

FOREIGN PATENT DOCUMENTS 61-8298 3/1986 Japan .
61-2148 4/1986 Japan .
1410004 10/1975 United Kingdom ..... 180/19.2

*Primary Examiner*—Joseph J. Rolla
*Assistant Examiner*—Kenneth Noland
*Attorney, Agent, or Firm*—Lahive & Cockfield

[57] ABSTRACT

A hand-operated lift truck includes a pump unit adapted to operate a hydraulic cylinder which in turn serves to move a fork up and down above a chassis. The pump unit is positioned right above one of a pair of rear wheels of the lift truck and includes a pumping handle for operating a plunger pump. The pumping handle is rotatable about its own axis and linked at the lower end to a support which supports the one rear wheel stated, so that when rotated the handle causes the one rear wheel to turn integrally with it. The pumping handle, therefore, bifunctions as a steering handle which is easy to operate. In addition, because the pumping handle is rotatable as stated, it can be tilted and untilted to drive the pump even if the space available at the rear of the lift truck is narrow.

2 Claims, 4 Drawing Sheets

HAND-OPERATED LIFT TRUCK

BACKGROUND OF THE INVENTION

1. Field of the Invention

The present invention relates to a lift truck and, more particularly, to a hand-operated lift truck of the type having a fork which is lifted by a hydraulic mechanism.

2. Description of the Prior Art

A prior art lift truck of the type described includes a chassis with wheels, a hydraulic cylinder mounted on the chassis, a fork movable up and down driven by the cylinder, and a pump unit mounted on the rear end of the chassis with respect to the longitudinal direction of the truck. Adapted to supply the cylinder with working fluid under pressure, the pump unit consists of a plunger pump and a pumping handle which is movable about a pivot to drive the plunger pump. The fork is elevated to a desired level by tilting and untilting the pumping handle generally in the longitudinal direction of the lift truck. A problem with such a construction is that the pumping handle cannot be moved back and forth in that particular direction unless a sufficient space is available behind the lift truck, i.e., one cannot manipulate the handle backing on a wall and others.

Further, both of the rear wheels of the prior art lift truck are implemented with casters which are freely turnable to change their orientation. To reorient the lift truck, a handle which is independent of the pumping handle and fixed to the chassis is gripped to twist the whole lift truck. Such, however, requires effortful handling, especially when the fork is loaded with heavy articles.

Meanwhile, there have been proposed a lift truck in which a plunger pump is selectively driven by a pumping handle and a foot-operated pedal in order to solve the space requirement problem as discussed above, and a lift truck in which an extra handle for steering is associated with rear wheels to facilitate steering operations. However, these schemes known in the art are disproportionately complicated in construction and expensive.

SUMMARY OF THE INVENTION

It is therefore an object of the present invention to provide a hand-operated lift truck having a pumping handle which can be operated even when a sufficient space is not available behind the lift truck.

It is another object of the present invention to provide a hand-operated lift truck which can be reoriented by a minimum of effort.

It is another object of the present invention to provide a simple and inexpensive hand-operated lift truck.

It is another object of the present invention to provide a generally improved hand-operated lift truck.

A hand-operated lift truck of the present invention includes a chassis provided with a right and a left wheels at each of a front and a rear ends thereof, a hydraulic cylinder mounted upright on the chassis, and a fork elevatable to a desired level above the chassis driven by the cylinder. A pump unit is disposed directly above one of the right and left rear wheels for supplying working fluid under pressure to the cylinder. The pump unit consists of a pump and a pumping handle for operating the pump. A link mechanism is provided which links the one rear wheel stated and the pumping handle such that the one rear wheel and the pumping handle are rotatable integrally with each other in a horizontal direction.

In a preferred emodiment, the link mechanism comprises a plate rotatably mounted on an upper surface of a bracket which is supported by the chassis, a generally L-shaped arm which is connected at one end to a support supporting the one rear wheel and at the other end to a side of the plate, and a generally U-shaped frame member mounted on the plate and to which the pumping handle is journalled.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
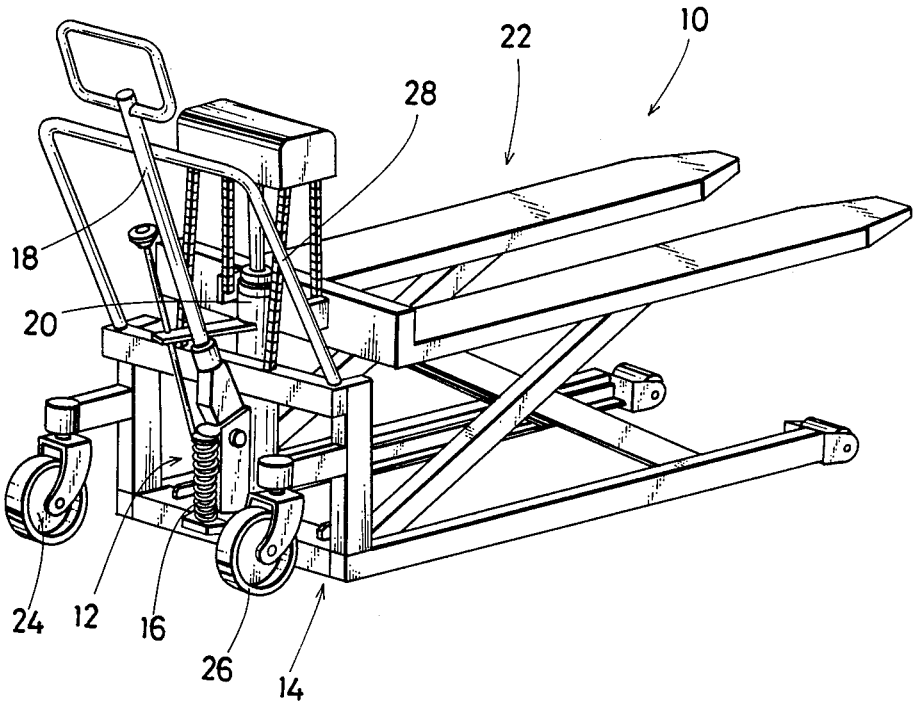
FIG. 1 is a perspective view of a prior art lift truck.

To better understand the present invention, a brief reference will be made to a prior art hand-operated lift truck, shown in FIG. 1. The prior art lift truck, generally 10, includes a pump unit 12 which is mounted on substantially the intermediate between both sides of the rear end of a chassis 14. The pump unit 12 is made up of a plunger pump 16 and a pumping handle 18 which is tiltable generally in the longitudinal direction of the lift truck 10 to operate the plunger pump 16. As the pumping handle 18 is moved back and forth in the above direction at the rear end of the chassis 14, it drives the plunger pump 16 which then supplies a hydraulic cylinder 20 with working fluid under pressure. As a result, a fork 22 is elevated by the cylinder 20 to a desired level.

The lift truck 10 has rear wheels 24 and 26 both of which are implemented with casters the orientation of which is free to change. An exclusive moving handle 28 is rigidly connected to a frame member provided on the chassis 14 in order to move the lift truck 10. To turn the lift truck 10, one grips the moving handle 28 and twists the whole lift truck 10 in a desired direction.

The prior art lift truck 10 with the above construction has various drawbacks from the manipulation standpoint, as previously discussed.

Figure 2:
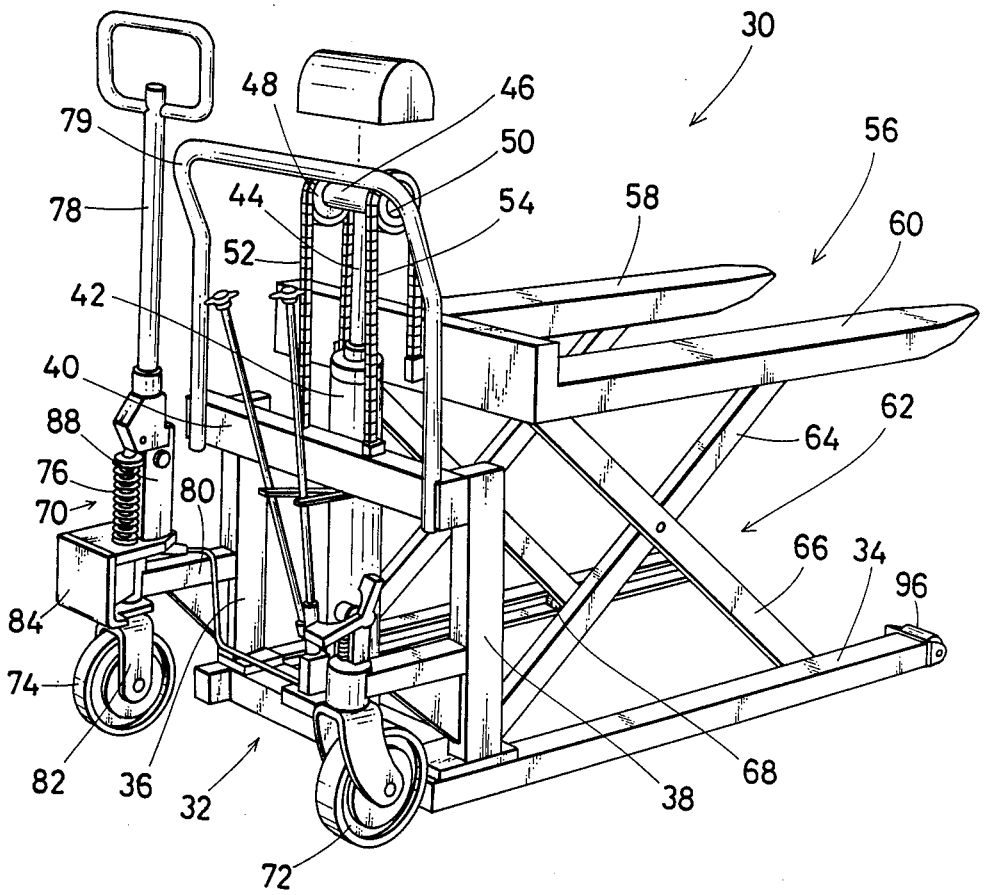
FIG. 2 is a perspective view of a lift truck in accordance with the present invention.

Referring to FIG. 2, a hand-operated lift truck embodying the present invention is shown and generally designated by the reference numeral 30. As shown, the lift truck 30 includes a chassis 32 a part of which is constituted by a bottom frame 34. A pair of upright posts 36 and 38 extend from rear end portions of the bottom frame 34. A crossbar 40 is fixed at one end thereof to the post 36 and at the other end to the post 38.

A hydraulic cylinder 42 is mounted upright on the chassis 32 at substantially the intermediate between the posts 36 and 38 and with a piston rod 44 thereof facing upwardly. A rotary shaft 46 having a pair of sprockets 48 and 50 mounted on axially opposite ends thereof is mounted on the upper end of the piston rod 44 such that it is capable of moving up and down integrally with the piston rod 44 and moving in a rotational motion about an axis thereof. The rotary shaft 46 is so arranged as to extend perpendicularly to the piston rod 44 and symmetrically with respect to the axis of the piston rod 44. Chains 52 and 54 are passed over the sprockets 48 and 50, respectively. Each of the chains 52 and 54 is anchored at one end to the crossbar 40, which is located below the sprockets 48 and 50, and at the other end to the rear end of a fork 56 which will be described. In this construction, when the piston rod 44 is forced upwardly out of the cylinder 42, it raises the shaft 46 with the result that the fork 56 is lifted by the chains 52 and 54. Conversely, as the piston rod 44 is pulled down into the cylinder 42, the fork 56 is lowered through the chains 52 and 54.

The fork 56 has a pair of parallel arms 58 and 60 which are connected together at the rear ends thereof. The arms 58 and 60 may be directly loaded with articles or thrusted into a pallet to lift articles together with the pallet. The fork 56 is linked to the bottom frame 34 by a pair of identical collapsible legs which are situated at both sides of the chassis 1 symmetrically to each other, only one of the legs 62 being shown with a reference numeral 62. Specifically, each leg 62 comprises two bars, or leg members, 64 and 66 which intersect each other in an X configuration. The bars 64 and 66 are pivotted at one end to a rear end portion of the chassis 32 and that of the arm 60 (or 58) of the fork 56, respectively. Rollers 68 are mounted on the other end of the bars 64 and 66 and each is rollably received in a channel (no numeral) which extends in the arm 60 (58) or the bottom frame 34 in the longitudinal direction of the lift truck 30. In this construction, when the rear end of the fork 56 is pulled up by the chains 52 and 54 which are passed over the sprockets 48 and 50, the front end of the fork 56 is supported by the legs 62 at the same level as the rear end and, hence, the arms 58 and 60 are constantly maintained in a horizontal position.

A pump unit 70 adapted to supply working fluid under pressure to the cylinder 42 is positioned above one of right and left rear wheels 72 and 74 which are located behind the rear end of the chassis 32. In this particular embodiment, the pump unit 70 is shown as being associated with the left rear wheel 74. The pump unit 70 consists of a plunger pump 76 and a pumping handle 78. When the pumping handle 78 is tilted and untilted as will be described, it drives the plunger pump 76 to supply working fluid under pressure to the cylinder 42, thereby raising the piston rod 44 to a desired level. In the illustrative embodiment, the plunger pump 76 is operated by a mechanism which is installed in ordinary lift trucks and, hence, a detailed description thereof will be omitted to avoid redundancy.

The right rear wheel 72 is supported by the post 38 in such a manner as to be freely rotatable in the horizontal direction. The left rear wheel 74, on the other hand, is rotatable in the horizontal direction integrally with the pumping handle 78 of the pump unit 70 which is mounted on a bracket 80.

Figure 3:
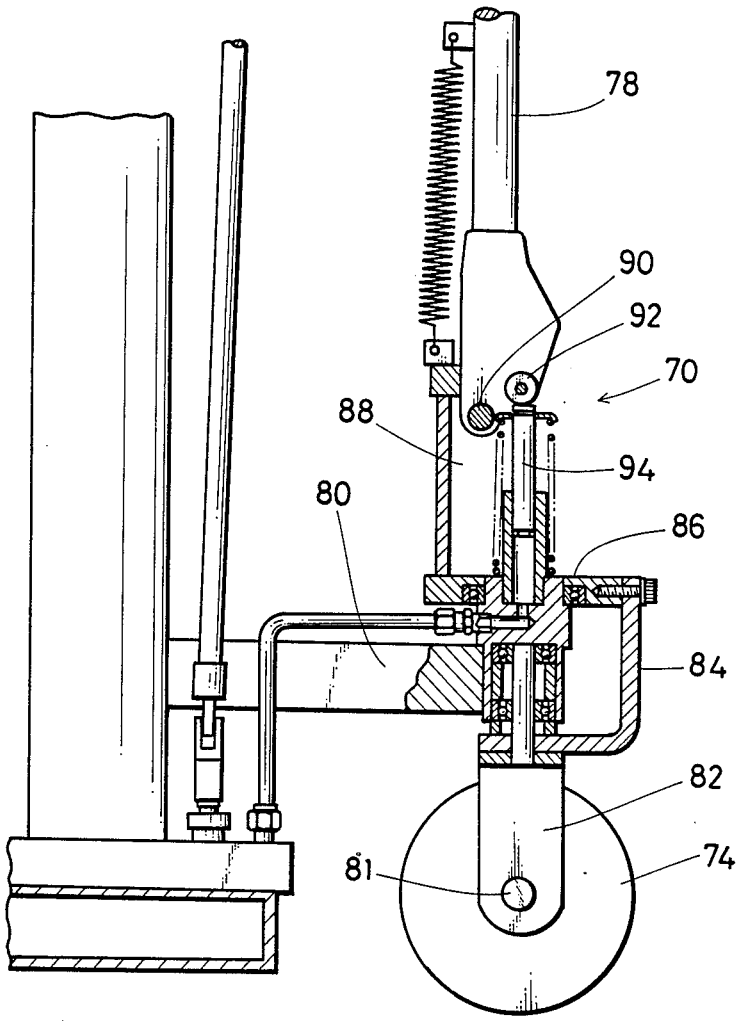
FIG. 3 is a fragmentary section showing a rear wheel mounting portion of the lift truck of FIG. 2 which constitutes one of charactreristic features of the present invention.

Referring to FIG. 3, details of the particular section of the lift truck 30 where the left rear wheel 74 and the pump unit 70 are mounted is shown. The wheel 74 has an axle 81 which is rotatably supported by a frame member 82. A generally L-shaped connecting arm 84 is fixed at one or lower end to the frame member 82 and at the other or upper end to a side of a plate 86, which is rotatably mounted on the bracket 80. In this configuration, the connecting arm 84 allows the rear wheel 74 to rotate integrally with the plate 86 in the horizontal direction. A generally U-shaped frame member 88 is rigidly mounted on the rotatable plate 86 while the lower end of the pumping handle 78 is journalled to and within the frame member 88 by a shaft 90. A pressure roller 92 is mounted on the lower end of the pumping handle 78 and held in abutting engagement with the upper end of a piston 94 of the plunger pump 76. As the pumping handle 78 is operated back and forth about the shaft 90, the pressure roller 92 presses the piston 94 of the plunger pump 76 downwardly so as to supply working fluid under pressure to the cylinder 42.

As shown in FIG. 2, the chassis 32 is provided with front wheels 96 (only one is visible) at the front end thereof. The front wheels 96 cooperate with the rear wheels 72 and 74 during movement of the lift truck 30.

An operating mechanism and a hydraulic system associated with the pump unit 70 are the same as those of a prior art pump unit and, therefore, will not be described herein. What is to be noted in this particular embodiment is that the pump unit 70 which is associated with the rear wheel 74 is fluidly communicated to the operating mechanism and hydraulic system by a piping, as schematically shown in FIGS. 2 and 3.

In the lift truck 30 constructed as described above, when the pumping handle 78 is rotated about its own axis, as distinguished from the movement about the shaft 90, the rotation is transmitted to the rear wheel 74 by the frame member 88, rotatable plate 86 and arm 84 with the result that the wheel 74 is reoriented in the horizontal direction. That is, the handle 78 serves not only a pumping function but also a steering function and allows the lift truck 30 to be turned by a minimum of effort even when the fork 56 is loaded with heavy articles. Meanwhile, because the handle 78 is rotatable as stated, it can be tilted in any of various suitable orientations for operating the pump unit 70. Specifically, when a sufficient space is not available behind the lift truck 30, the handle 78 may be so rotated as to be tiltable sideways with respect to the longitudinal direction of the lift truck 30. This enhances loading operations in limited spaces.

In the illustrative embodiment, the fork 56 and the bottom frame 34 are interlinked by the collapsible legs 62. The fork 56, therefore, attains high stability against unbalanced loads despite that it is suspended at one end only. In addition, because a cylinder and other obstructions are absent in the space below the fork 56, the fork 56 may be lowered to an extreme level in order to raise even a pallet which is placed flat on a floor.

Figure 4:
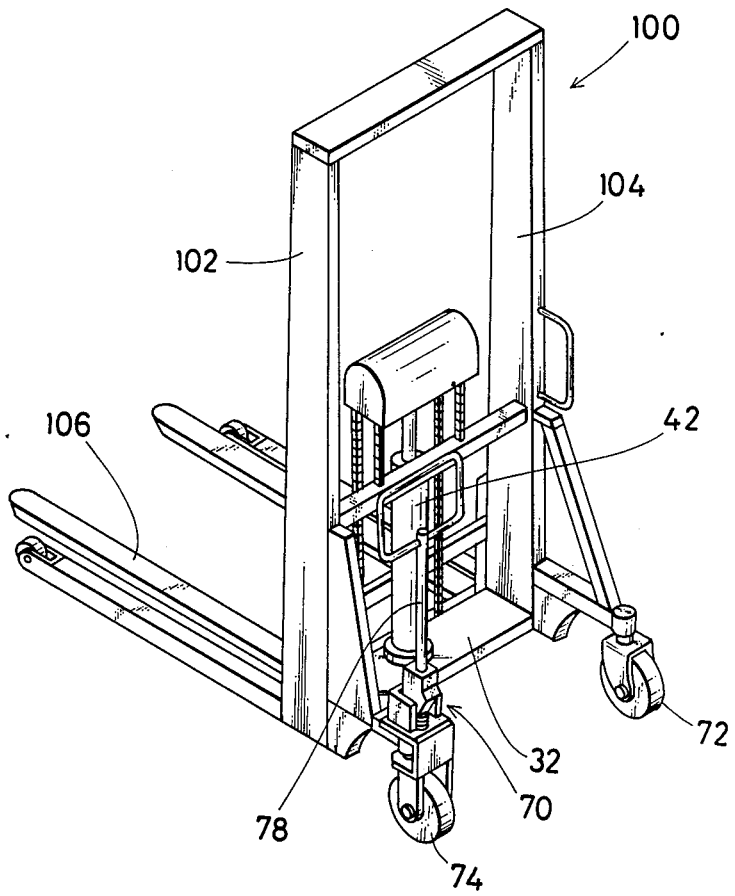
FIG. 4 is a perspective view of a modification to the embodiment shown in FIGS. 2 and 3.

Referring to FIG. 4, a modification to the embodiment of FIGS. 2 and 3 is shown. In FIG. 4, the same or similar structural elements as those of FIGS. 2 and 3 are designated by like reference numerals and details thereof will not be described to avoid redundancy. The modified lift truck, generally 100, includes a pair of relatively tall posts 102 and 104 which extend upwardly from the chassis 32. A fork 106 is guided by and movable up and down along the posts 102 and 104.

In summary, it will be seen that the present invention provides a hand-operated lift truck which can be steered with ease even when loaded with heavy articles and can be readily manipulated within a limited space. This unprecedented advantage is derived from a unique construction wherein a pumping unit is associate with one of two rear wheels of the truck and a combined pumping and steering handle is rotatable integrally with that particular rear wheel about an axis thereof.

Various modifications will become possible for those skilled in the art after receiving the teachings of the present disclosure without departing from the scope thereof. For example, the bifurcated fork 56 or 106 may be replaced with a pallet type fork or the like.

What is claimed is:

1. A hand-operated lift truck comprising a. a chassis having a front end with a pair of opposed wheels and a rear end with a pair of opposed wheels;

b. an upright hydraulic cylinder mounted on said chassis;

c. a horizontal fork mounted on said chassis for vertical movement by said cylinder;

d. a pump unit disposed directly above and connected to one of the rear wheels of chassis, said pump unit also connected to said cylinder for supplying fluid under pressure thereto to operate said cylinder so that the cylinder is able to move the fork vertically, said pump unit including an upright pump and an upright pumping handle; and e. a link means for connecting said pumping handle to one of the rear wheels, said link means including i. a horizontal bracket projecting outwardly from the rear end of said chassis, ii. a generally U-shaped upright member into which part of the lower end portion of said handle projects and in which said part of the lower end portion of said handle is pivotally connected to a horizontal shaft extending through the upper portion of said U-shaped member, thus allowing said handle to perform pivotal movements in a vertical plane, iii. a horizontal plate mounted on said bracket for horizontal rotary movement relative to said bracket, said U-shaped member being fixed to said plate at its lower end, and iv. a generally L-shaped member having an upper end portion fixed to one end of said plate and a lower end portion fixed to a means for supporting one of said wheels, said bracket adapted to allow one of said rear wheels to be horizontally rotated upon rotation of said pumping handle.

2. A hand-operated lift truck comprising:

a. a chassis having a front end with a pair of opposed wheels and a rear end with a pair of opposed wheels;

b. an upright hydraulic cylinder mounted on the chassis;

c. a horizontal fork mounted on the chassis and adapted for vertical movement by the cylinder;

d. a pump means, comprising a pump and a pumping handle, connected to and disposed above one of the rear wheels, the pump means also connected to the cylinder for supplying pressurized fluid thereto to facilitate vertical movement of the fork; and e. link means for connecting one of the rear wheels with the pumping handle to enable the wheel and the pumping handle to be integrally rotatable with each other about a vertical axis, said link means including i. a plate rotatably mounted on an upper surface of a bracket which is supported by said chassis, ii. a generally L-shaped arm connected at one end to a means for supporting one of the rear wheels and at the other end to one side of the plate, and iii. a generally U-shaped frame member mounted to the plate and to which the pumping handle is journalled.

* * * * *